US008770799B2

(12) United States Patent
Becker et al.

(10) Patent No.: US 8,770,799 B2
(45) Date of Patent: Jul. 8, 2014

(54) LAMP UNIT

(75) Inventors: Juergen Becker, Berlin (DE); Kilian Klages, Detmold (DE); Karsten Pietsch, Berlin (DE); Matthias Protsch, Berlin (DE)

(73) Assignee: Osram AG, Munich (DE)

( * ) Notice: Subject to any disclaimer, the term of this patent is extended or adjusted under 35 U.S.C. 154(b) by 141 days.

(21) Appl. No.: 13/394,817

(22) PCT Filed: Aug. 30, 2010

(86) PCT No.: PCT/EP2010/062640

§ 371 (c)(1),
(2), (4) Date: Mar. 8, 2012

(87) PCT Pub. No.: WO2011/029741

PCT Pub. Date: Mar. 17, 2011

(65) Prior Publication Data

US 2012/0176798 A1 Jul. 12, 2012

(30) Foreign Application Priority Data

Sep. 8, 2009 (DE) ..... 10 2009 040 572

(51) Int. Cl.
*F21V 7/10* (2006.01)

(52) U.S. Cl.
USPC ..... 362/296.01; 313/318.01; 362/651

(58) Field of Classification Search
USPC ..... 362/296.1, 548, 549, 651, 652; 313/318.01, 318.09, 318.12
See application file for complete search history.

(56) References Cited

U.S. PATENT DOCUMENTS

| | | | | |
|---|---|---|---|---|
| 4,774,645 | A * | 9/1988 | Iwamoto | 362/652 |
| 5,634,705 | A * | 6/1997 | Michino | 362/548 |
| 6,005,336 | A * | 12/1999 | Helbig et al. | 313/318.01 |
| 6,031,323 | A | 2/2000 | Behr et al. | |
| 6,082,883 | A * | 7/2000 | Tatsumi et al. | 362/548 |
| 6,773,138 | B2 * | 8/2004 | Coushaine | 362/656 |
| 6,923,555 | B2 * | 8/2005 | Byggmastar | 362/651 |
| 7,275,855 | B2 * | 10/2007 | Protsch et al. | 362/652 |
| 8,162,258 | B2 * | 4/2012 | Joannis et al. | 244/118.6 |
| 2002/0003391 | A1 | 1/2002 | Tsuda et al. | |
| 2007/0069651 | A1 | 3/2007 | Van Heeswijk et al. | |

FOREIGN PATENT DOCUMENTS

| | | | |
|---|---|---|---|
| DE | 102005009902 | A1 | 9/2006 |
| EP | 0786791 | B1 | 11/1999 |
| EP | 1455134 | A1 | 9/2004 |
| EP | 1605490 | A2 | 12/2005 |
| JP | 03092302 | U | 9/1991 |
| JP | 10083703 | A | 3/1998 |
| JP | 2005332821 | A | 12/2005 |
| JP | 2007520855 | A | 7/2007 |
| WO | 2006092112 | A2 | 9/2006 |

OTHER PUBLICATIONS

English Abstract of EP1455134 A1. Sep. 8, 2004.
English Abstract of JP10083703A, dated Mar. 31, 1998.

* cited by examiner

*Primary Examiner* — John A Ward

(57) ABSTRACT

In various embodiments, a lamp unit including a lamp which is inserted into a reflector and which has a base with a reference ring including at least one referencing surface which cooperatively interacts with a corresponding referencing element of a holder of the reflector, configured such that the lamp is separably connected to the holder through a bayonet coupling.

16 Claims, 14 Drawing Sheets

LAMP UNIT

RELATED APPLICATIONS

The present application is a national stage entry according to 35 U.S.C. §371 of PCT application No. PCT/EP2010/062640 filed on Aug. 30, 2010, which claims priority from German Application No. 10 2009 040 572.0, filed on Sep. 8, 2009.

TECHNICAL FIELD

Various embodiments relate to a lamp unit.

BACKGROUND

A lamp unit of said type can in principle be used in a multiplicity of single-ended lamps. However, the main field of application is most likely to be in lamp units for vehicle headlights. A lamp unit for such motor vehicle headlights is described for example in EP 1 605 490 A2 and DE 10 2005 009 902 A1.

In these known solutions the lamp unit has a discharge lamp, such as is marketed for example under the product name "Xenarc™". Said high-pressure discharge lamp has a single-part or multipart lamp base by way of which it can be inserted into a holder of a reflector of a motor vehicle headlight. In order to align the lamp in the reflector and prevent incorrect installation of different lamp types, one or more referencing and coding recesses are embodied on a referencing ring of the base, which recesses cooperatively interact with corresponding projections on the holder of the reflector in order to ensure that the lamp can only be inserted at a predetermined relative position with respect to the holder. Said referencing means furthermore prevents lamps of an unapproved type from being used in a motor vehicle headlight.

In the conventional solutions a plurality of radially projecting supplementary elements which form part of the headlight are additionally arranged on the base of the high-pressure discharge lamp, with which mechanical components, for example clips, brackets, coupling cages or the like come into engaging contact in order to fix the base at a defined position in the holder of the reflector.

A disadvantage with said solutions is that firstly lamp units of this type are relatively complex in terms of their structure, since the additional components must be provided for ensuring correct positional fixing. Secondly, the assembly overhead is increased due to the attachment of the additional components.

SUMMARY

Various embodiments create a lamp unit which has a simple structure and can be assembled with little effort.

According to various embodiments, the lamp unit is implemented by means of a lamp which is inserted into a reflector and has a base with a reference ring on which at least one referencing surface is embodied. This cooperatively interacts with a corresponding referencing element of a holder of the reflector. The lamp is connected to the reflector by means of a separable bayonet coupling.

Using a bayonet coupling enables the lamp to be connected directly to the reflector, so the time-consuming and labor-intensive assembly of the supplementary components, for example the clips, brackets or coupling cages described in the introduction, can be dispensed with and consequently both the equipment-related overhead and the assembly effort are reduced.

In various embodiments, the bayonet coupling embodied on the reference ring has circumferentially open-ended cutouts with which bayonet cams projecting radially from the inner circumferential surface of the holder are associated. When the lamp is inserted into the reflector, said bayonet cams are in overlapping alignment with the cutouts and engages behind the reference ring in the locked state.

Locating pegs for positioning the reference ring which are offset relative to the bayonet cams can be embodied on the inner circumferential surface of the holder.

It is preferred in this case if reference studs are embodied on an annular surface of the reference ring on the locating peg side and said reference studs can be brought into defined engaging contact with the said locating pegs.

In various embodiments, stop dogs onto which the bayonet cams run during the connecting action are embodied on the outer circumference of the base in order to define the locking position in an unmistakable manner.

In various embodiments, a stop dog is embodied on the inner circumferential surface at roughly the same axial level as the locating pegs and has a stop section extending roughly in a longitudinal direction of the reflector toward the bayonet cams and spaced apart from the inner circumferential surface.

When the lamp is inserted, the stop section drops into a latching groove of the reference ring, with an edge section of the latching groove running onto the stop dog.

The latching groove can be embodied as a recess in the sidewalls of a cutout with little outlay in terms of additional equipment.

In order to arrest the lamp base in the circumferential direction, the stop section can be engaged from behind in a locking position of the lamp by a locking projection embodied on a base surface of the cutout.

In order to enable a substantially play-free locking of the lamp base in the reflector, the latching groove can be embodied such that in the locking position the reference ring can be clamped by way of the stop dog against pretensioning elevations embodied roughly opposite the stop dog on the inner circumferential surface.

In various embodiments, a radial recess is incorporated into the inner circumferential surface roughly between the bayonet cams and the locating pegs. Arranged in said recess is an elongate spring hook extending roughly along an inner diameter of the inner circumferential surface. A hook section of the spring hook projects radially inward in the region of a bayonet cam, with a section of the cutout of the reference ring running onto said hook section during the locking action.

A shaft of the spring hook is advantageously embodied such that the spring hook clamps the reference ring in the locking position against the pretensioning elevations embodied roughly opposite the spring hook on the inner circumferential surface.

In the lamp unit according to various embodiments, as already mentioned, the supplementary components for fixing the lamp in the correct position in the reflector are superfluous, although if a lamp according to the invention is to be inserted into a conventional reflector, this can be accomplished in the conventional manner using additional radial pegs to support the supplementary components. This variant can then be used optionally in conventional holders as well as in holders according to various embodiments.

In a simply implemented exemplary embodiment with optimal fixing of the lamp in the reflector, three bayonet cams are formed on the holder of the reflector and three cutouts on the reference ring of the lamp. In principle, in a kinematic reversal or in accordance with the reversal principle, the cutouts could also be formed on the holder of the reflector and the bayonet cams on the base.

In a simply implemented exemplary embodiment, the cutouts extend roughly as far as the outer circumference of a base sleeve from which the reference ring projects radially.

According to various embodiments, the cutouts are formed roughly in a rectangular shape.

Three reference studs and three locating pegs are preferably provided in order to ensure the correct positioning of the lamp in the reflector on the face side.

The lamp unit is preferably implemented by means of a high-pressure discharge lamp for a motor vehicle headlight.

BRIEF DESCRIPTION OF THE DRAWINGS

In the drawings, like reference characters generally refer to the same parts throughout different views. The drawings are not necessarily to scale, emphasis instead being generally upon illustrating the principles of the invention. In the following description, various embodiments are described with reference to the following drawings, in which.

DETAILED DESCRIPTION

The following detailed description refers to the accompanying drawings that show, by way of illustration, specific details and embodiments in which the invention may be practiced.

Figure 1:
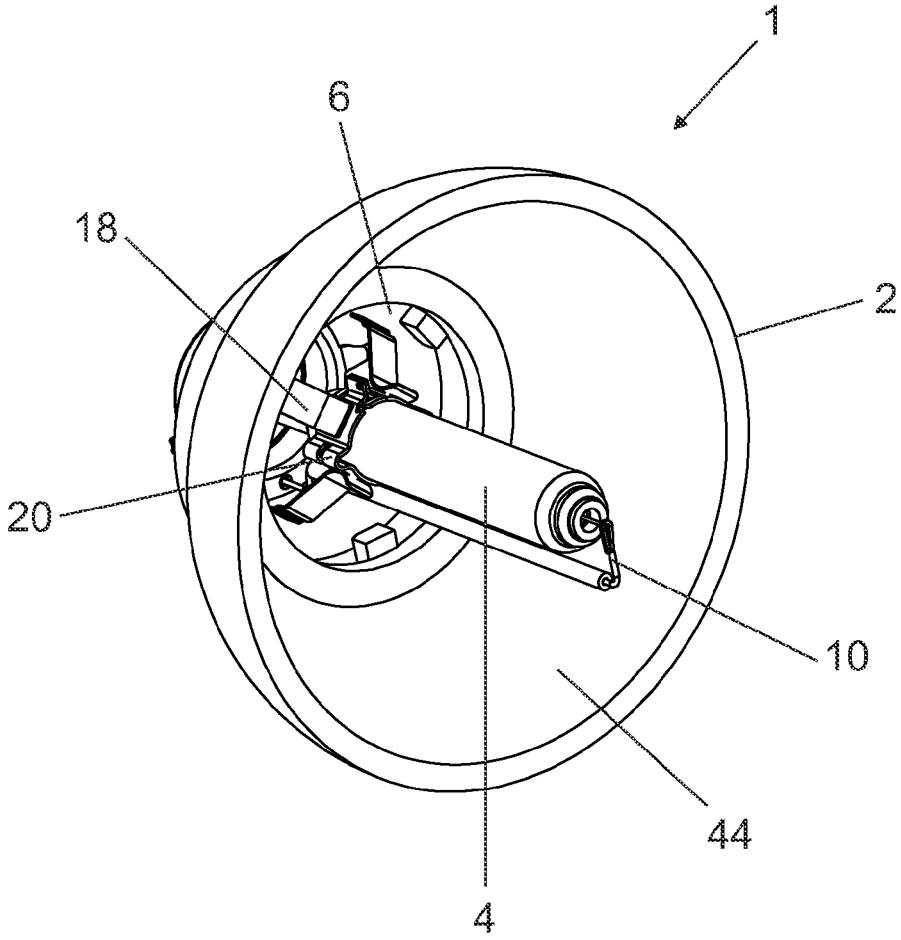
FIG. 1 is a three-dimensional schematic view of an inventive lamp unit according to a first exemplary embodiment.

FIG. 1 shows a three-dimensional view of a lamp unit 1 according to various embodiments, including a high-pressure discharge lamp 4 inserted into a reflector 2 of a motor vehicle headlight. Said lamp can be for example a metal halide high-pressure discharge lamp having an electrical power draw of approx. 25 W or a D1 to D4 lamp. High-pressure discharge lamps of this type are sufficiently well-known from the prior art, for example from EP 1 605 490 A2 or EP 0 786 791 B1, so only the components essential to an understanding of various embodimenys will be explained here and otherwise reference will be made to the cited prior art.

The special feature of the lamp unit 1 shown in FIG. 1 consists in the fact that the reflector 2 and the high-pressure discharge lamp 4 are connected to each other by means of a bayonet coupling 6, the difference compared to conventional solutions being that additional components such as clips, brackets or coupling cages are dispensed with.

Figure 2:
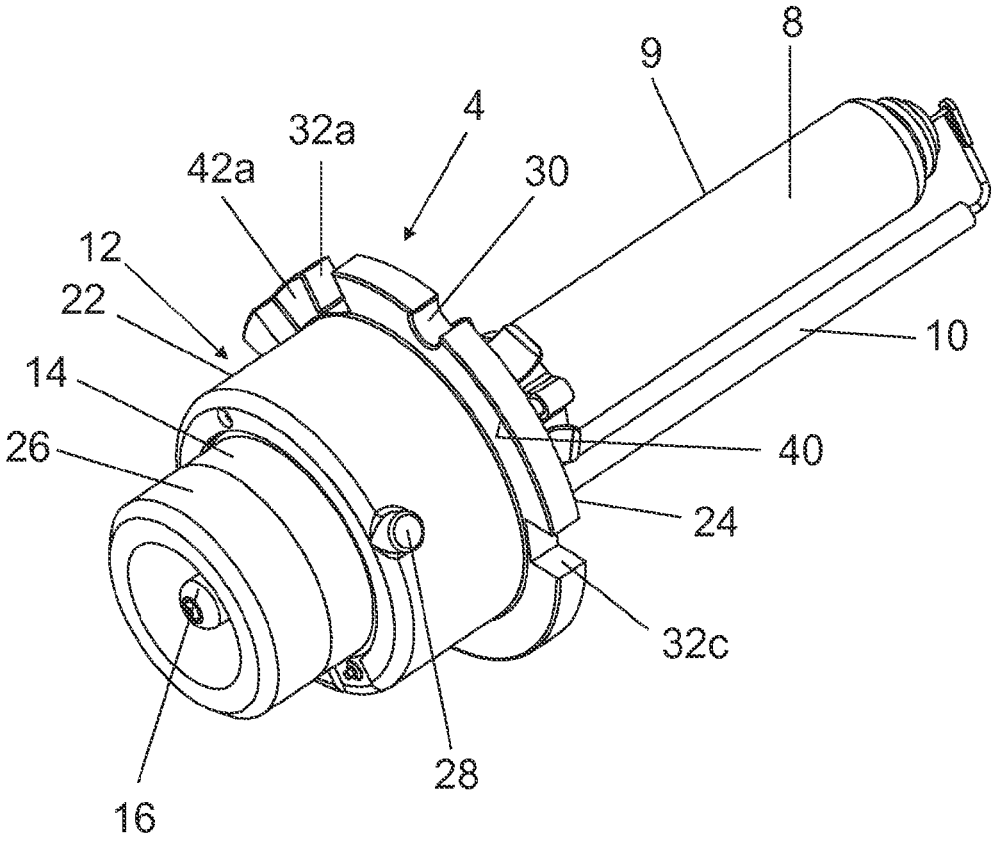
FIG. 2 shows a lamp of the lamp unit from FIG. 1 according to the first exemplary embodiment.

FIG. 2 shows an individual view of a mercury-free high-pressure discharge lamp 4. This has a discharge vessel (not visible here) with an interior space into which project two diametrically opposed electrodes which are connected via metal foil fused into the discharge vessel to a current lead 10 in each case or to a further current lead (not shown). The discharge vessel (not visible in FIGS. 1 and 2) indicated by the reference numeral 8 is housed in an outer bulb 9 which consists likewise of fused quartz glass and optionally is provided with an ultraviolet-radiation-absorbing coating.

The outer current lead 10 visible in FIGS. 1 and 2 is connected to a contact ring 14 arranged circumferentially around a base 12. The axial current lead that is not shown makes electrical contact with a central contact pin 16 of the base 12 (see FIG. 2). The interior space of the discharge vessel 8 is filled with an ionizable filling consisting, for example, of ultrapure xenon gas and a plurality of metal halides.

Embedded in the base 12, which conventionally is implemented using multiple parts, is a metal ring embodied with spring tabs 18 projecting outward toward the outer bulb 9. The spring tabs 18 embodied as welding lugs are curved with respect to a support collar 20 mounted onto the outer bulb 9 and joined to said collar by welding, for example. The high-pressure discharge lamp 4 is reliably centered correctly in position in the axial direction by means of the four spring tabs/welding lugs 18 and the correspondingly configured support collar 20. With regard to further details of the structure of the base 12, reference is made to the above-cited prior art.

Figure 3:
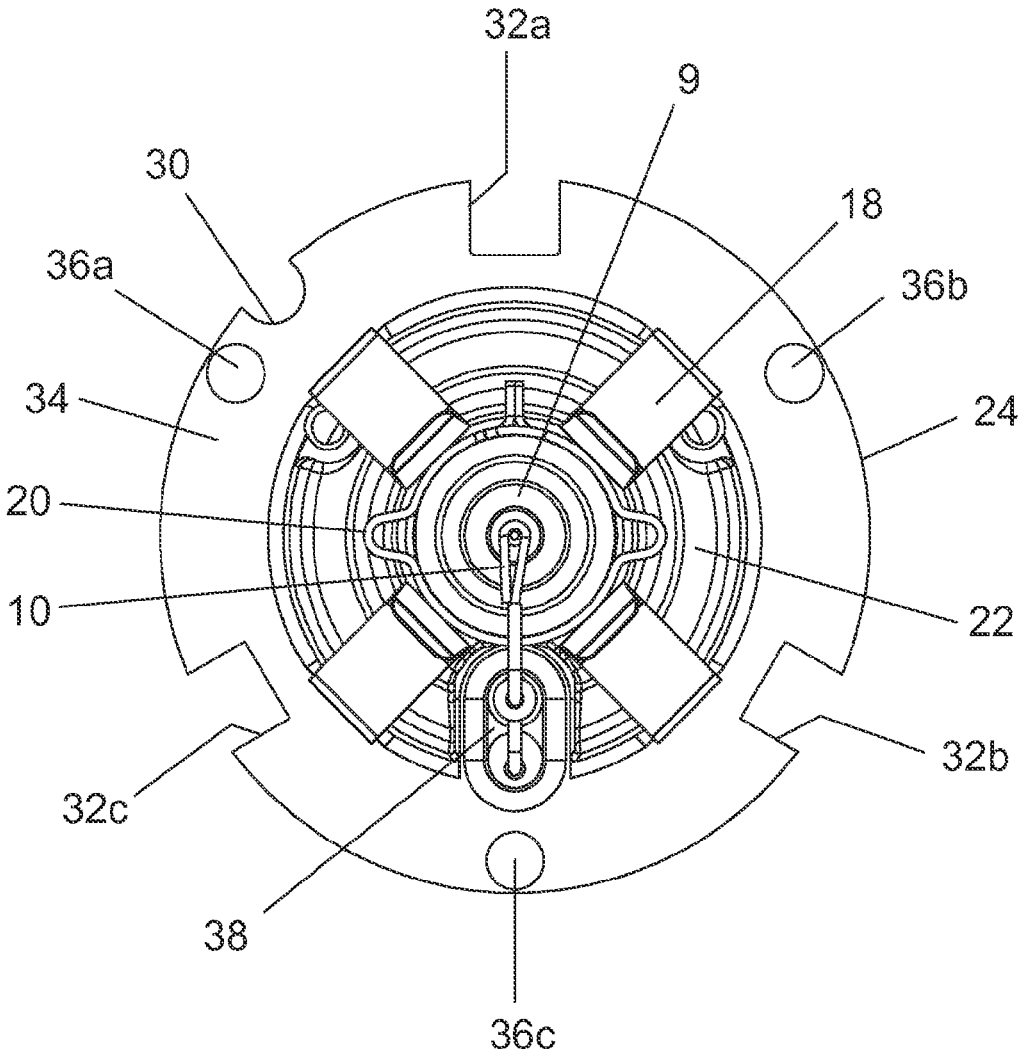
FIG. 3 shows a front view of the lamp from FIG. 2 according to the first exemplary embodiment.
Figure 4:
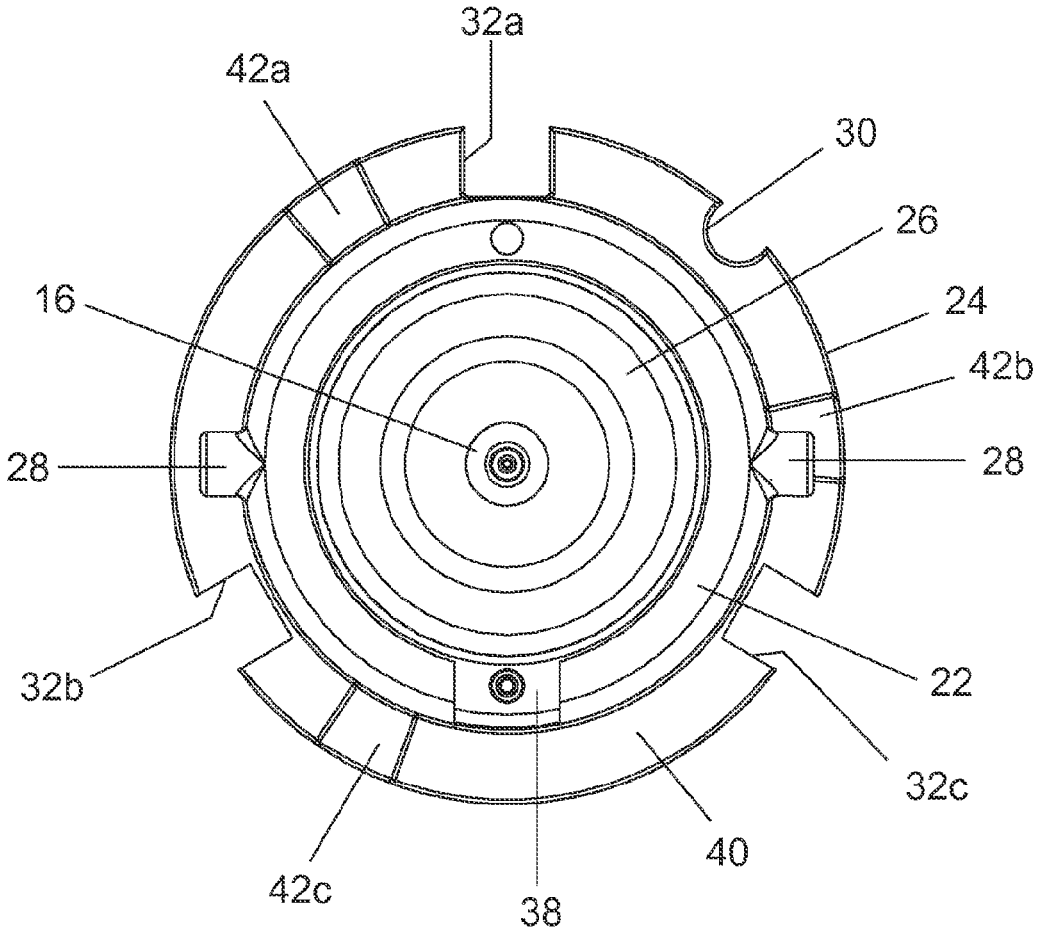
FIG. 4 shows a rear view of the lamp from FIG. 2 according to the first exemplary embodiment.

FIG. 3 shows a front view and FIG. 4 a rear view of the high-pressure discharge lamp 4 according to FIG. 2. According thereto, the base 12 has a base sleeve 22 from which a reference ring 24 projects circumferentially in the radial direction. The end section of the base sleeve 22 furthest from the reference ring 24 transitions via a radial step into a contact band 26 on the outer circumference of which the circumferential contact ring 14 is formed and which encircles the central contact pin 16 with a clearance.

Provided on the outer circumference of the base sleeve 22 in the region of the radial step to the contact band 26 and arranged diametrically opposite each other are two (see FIG. 4) radial pegs 28 which serve for securing an electrical connector by means of a bayonet union. In the exemplary embodiment shown, these two radial pegs 28 have no function.

The reference ring 24 embodied on the base sleeve 22 has at least one coding groove 30 which, in the exemplary embodiment shown, is implemented as a semicircular recess. It is ensured by means of said coding groove or coding grooves that only a specific type of high-pressure discharge lamp 4 can be inserted into the motor vehicle headlight at a predetermined relative position. Also implemented on the reference ring 24 in addition to the coding groove 30 are three cutouts 32*a*, 32*b*, 32*c* which are evenly distributed around the circumference and which, in the view according to FIGS. 3 and 4, have an approximately rectangular cross-section and extend from the outer circumference of the reference ring 24 as far as the base sleeve 22.

According to FIG. 3, three reference studs 36*a*, 36*b*, 36*c* offset relative to the cutouts 32 and the coding groove 30 and likewise evenly distributed around the circumference are provided on an end face 34 of the reference ring 24 on the outer bulb side, said studs projecting somewhat from the end face 34 in the axial direction and being brought into engaging contact with subsequently explained elements of the reflector in order to define the axial position of the high-pressure discharge lamp in the reflector.

According to the schematic shown in FIG. 3, the outer current lead 10 is connected to a contact plate 38 which can also be seen in the bottom view according to FIG. 4 and for its part is in electrical contact with the contact ring 14. As can be seen from FIG. 4, embodied on a rear end face 40 of the reference ring 24 are three stop dogs 42*a*, 42*b*, 42*c* which are in each case arranged adjacent to one of the cutouts 32 and which, in the view according to FIG. 4, extend out from the rear-side end face 40 toward the viewer. As explained in more detail hereinbelow, said stop dogs 42*a*, 42*b*, 42*c* limit the relative rotation between discharge lamp 4 and reflector 2.

Two of said stop dogs 42*a*, 42*b* are also visible in the view shown in FIG. 2. According thereto, the stop dogs 42 extend away from the outer circumference of the base sleeve 22 up to the outer circumference of the reference ring 24 and extend in the axial direction as far as the rear-side end face 40 (see FIG. 2).

Figure 5:
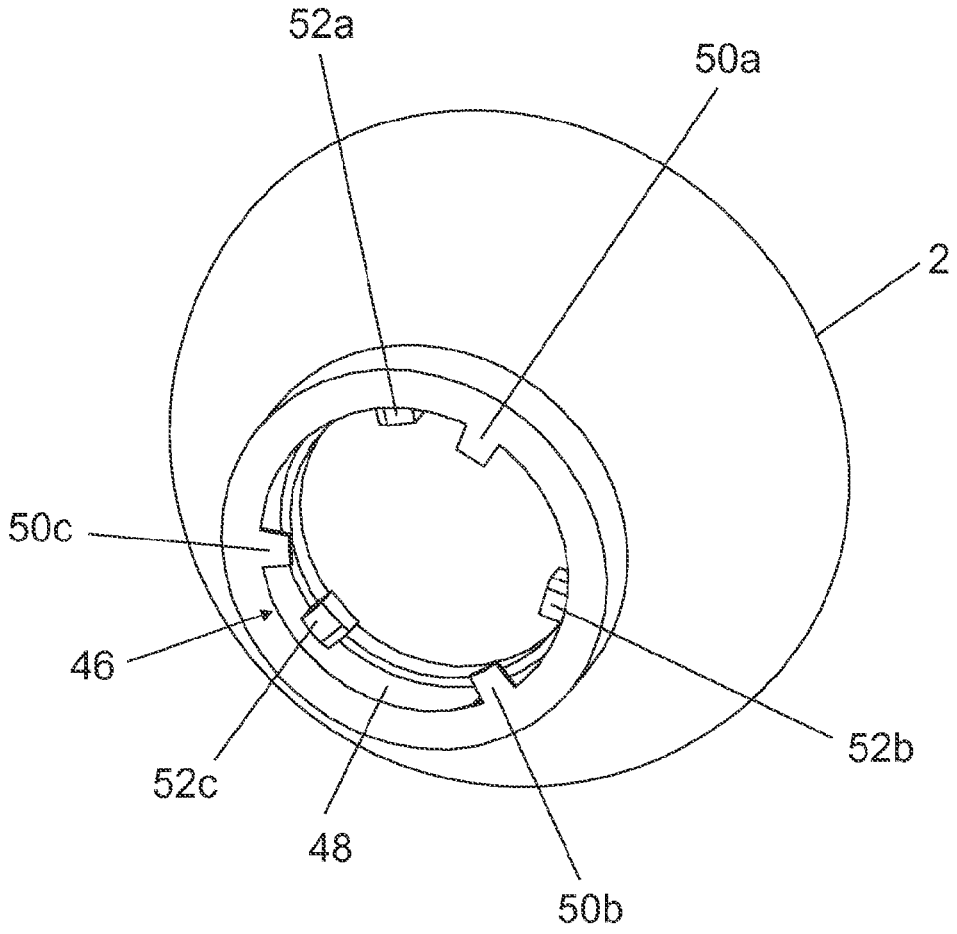
FIG. 5 shows an individual view of a reflector of the lamp unit from FIG. 1 according to the first exemplary embodiment.

FIG. 5 shows a three-dimensional view of the reflector 2 of the lamp unit 1 according to FIG. 1. Said reflector has a reflecting surface 44 (visible in FIG. 1), configured with the aim of achieving an optimal beam alignment, and a holder 46 which is implemented roughly as a section of a cylinder. Embodied on an inner circumferential surface 48 of the holder 46 are three bayonet cams 50*a*, 50*b*, 50*c* which, lying on the same pitch circle as the cutouts 32, are evenly distributed around the circumference, which project inward into the opening encircled by the holder 46, and the geometry of which roughly corresponds to that of the cutouts 32. Provided on the inner circumferential surface 48, offset in relation to said bayonet cams 50, are three locating pegs 52*a*, 52*b*, 52*c* which lie on the same pitch circle as the reference studs 36. The diameter of the inner circumferential surface 48 roughly corresponds to the outer circumference of the reference ring 24.

In order to insert the high-pressure discharge lamp 4 into the reflector 2, the cutouts 32*a*, 32*b*, 32*c* are first brought into overlapping alignment with one of the bayonet cams 50*a*, 50*b*, 50*c* in each case and the lamp is then inserted from behind (view according to FIG. 5) into the holder 46. As this is done, the bayonet cams 50*a*, 50*b*, 50*c* drop through the cutouts 32*a*, 32*b*, 32*c* and the front end face 34 (FIG. 3) comes up onto the corresponding contact surfaces of the locating pegs 52.

In a following assembly step, the high-pressure discharge lamp 4 is rotated to the right in the clockwise direction (view according to FIG. 6) with respect to the reflector 2 such that the bayonet cams 50*a*, 50*b*, 50*c* engage behind the reference ring 24 and, after a predetermined angle of rotation, run up onto the adjacent stop dogs 42*a*, 42*b* and 42*c*, respectively. In this rotation angle position, the three reference studs on the front end face 34 of the reference ring 24 bear against the adjacent end faces of the three locating pegs 52*a*, 52*b*, 52*c* provided for adjusting the axial position. In this assembly position, the discharge lamp 4 is clamped between the locating pegs 52 and the bayonet cams 50 in the axial direction and fixed in position in the circumferential direction by means of the holder 46 encompassing the reference ring 24, with the result that a reliable relative positioning between reflector 2 and high-pressure discharge lamp 4 is ensured with an extremely simple layout.

In the exemplary embodiment shown, the single-part or multipart base 12 is produced from a suitable plastic, the contact elements described being extrusion-coated in sections. The reflector is provided with a suitable coating and is likewise made of plastic.

Figure 6:
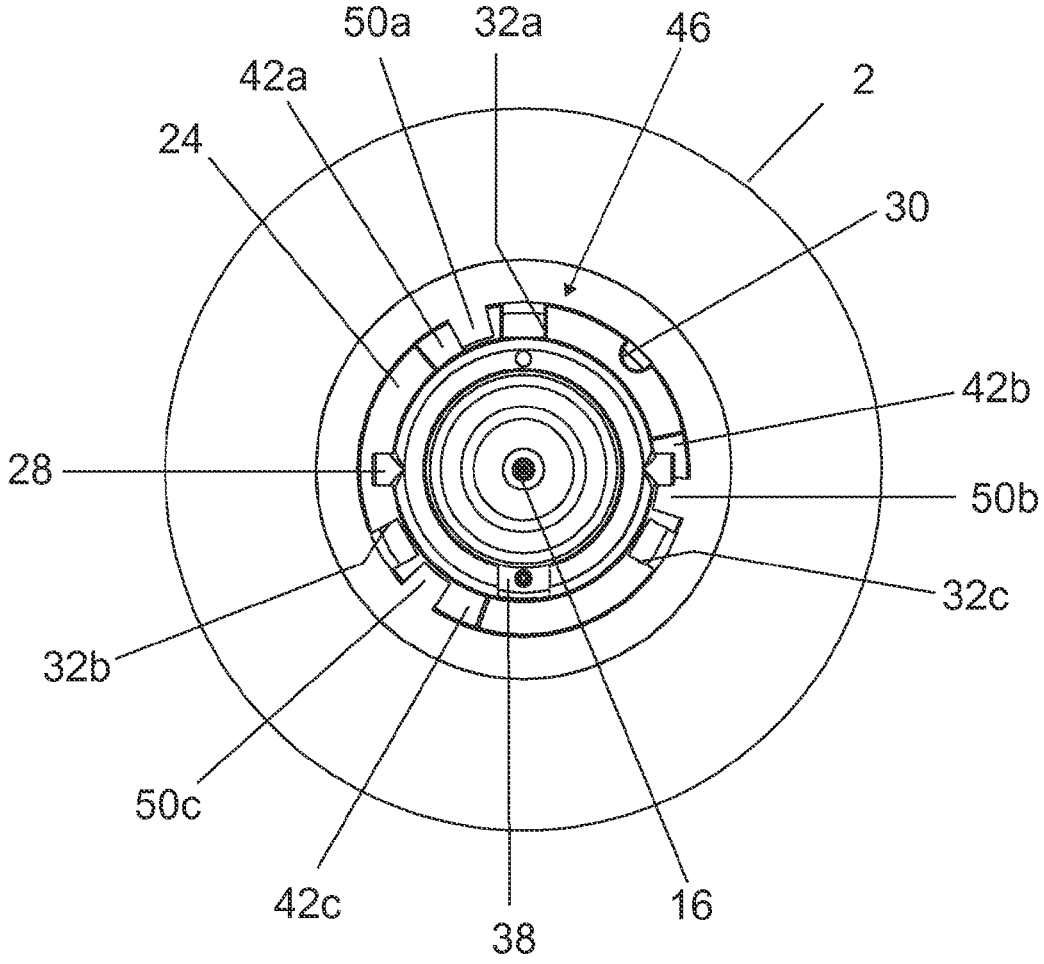
FIG. 6 shows a rear view of the lamp unit from FIG. 1 according to the first exemplary embodiment.

FIG. 6 shows a three-dimensional view of the reflector 2 of the lamp unit 1 from FIG. 1 according to a second exemplary embodiment. A ring 54 is embodied on the inner circumferential surface 48 of the reflector 2 at roughly the same axial level as the locating pegs 52. The inner diameter of the ring 54 lies roughly between the diameter of the inner circumferential surface 48 and the inner diameter of the locating pegs 52. Embodied on the ring 54 roughly between the two locating pegs 52*a* and 52*b* around the area of the bayonet cam 50*a* is an elongate stop dog 56 which extends roughly in the longitudinal direction of the reflector 2. A stop section 58 of the stop dog 56 projects outward here in the longitudinal direction toward the bayonet cam 50*a*.

Figure 7:
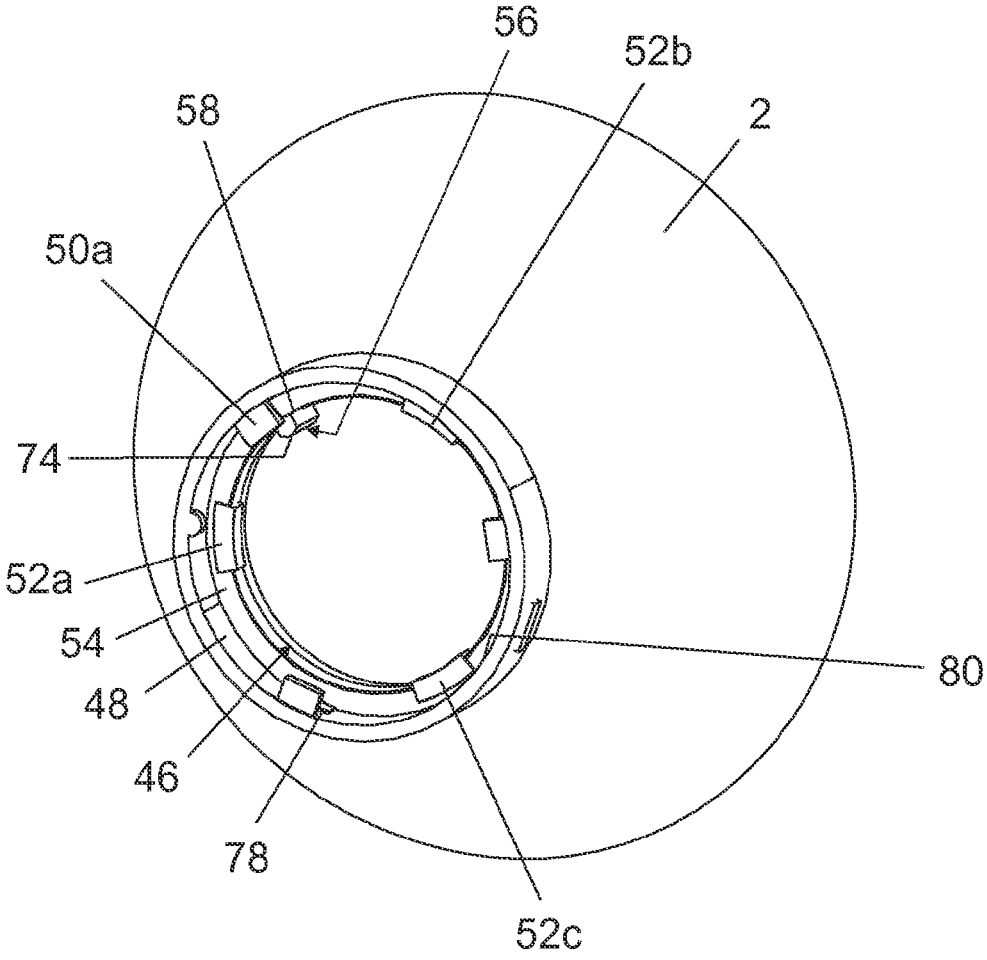
FIG. 7 shows an individual view of the reflector of the lamp unit according to a second exemplary embodiment.

The stop dog 56 serves to limit the relative rotation between the discharge lamp 4 and the reflector 2 from FIG. 1. For this purpose the reference ring 24 (shown in FIG. 8) of the base 12 from FIG. 12 according to the second exemplary embodiment has a cutout 60 with a latching groove 62 into which the stop dog 56 with the stop section 58 from FIG. 7 descends when the reference ring 24 is inserted into the reflector 2. A recess 68 or 70, respectively, is incorporated into a respective sidewall 64 or 66 of the cutout 60 in order to form the latching groove 62. Embodied centrally between the recesses on a base surface of the cutout 60 is a locking projection 72 which, in a locking position of the reference ring 24, engages behind the stop section 58 of the stop dog 56 from FIG. 7, as will be explained in more detail below.

Figure 8:
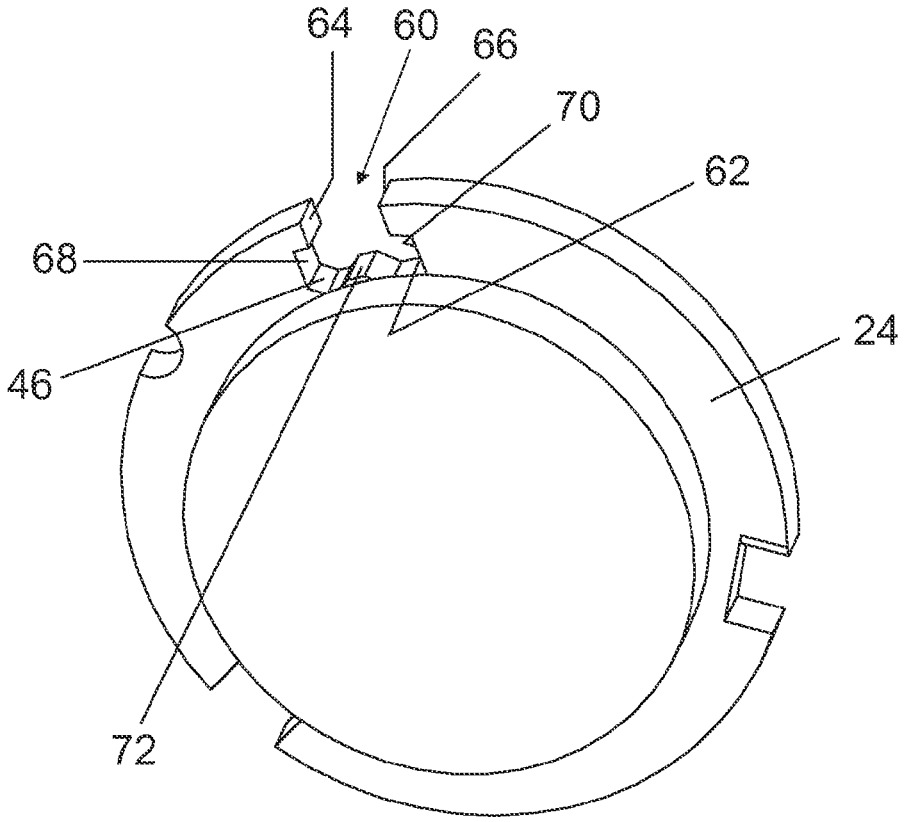
FIG. 8 shows an individual view of a reference ring according to the second exemplary embodiment.
Figure 9:
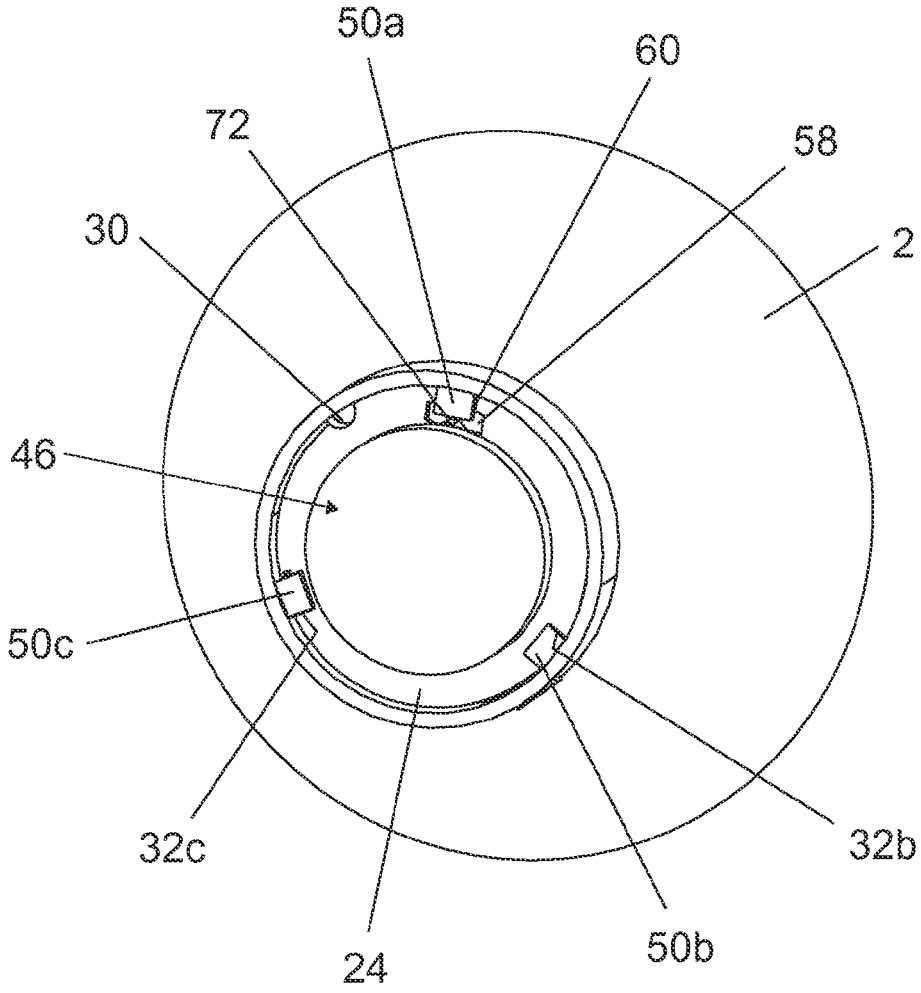
FIG. 9 shows a rear view of the reflector and the reference ring according to the second exemplary embodiment.
Figure 10:
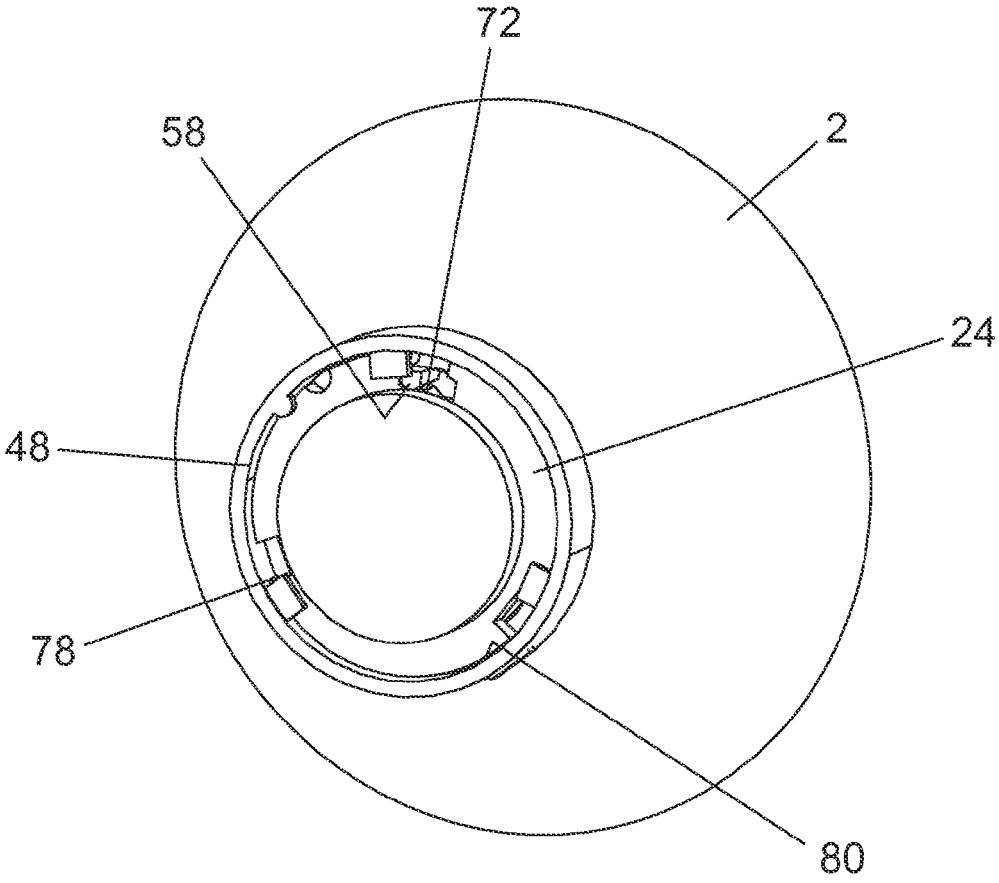
FIG. 10 shows a rear view of the reflector and the reference ring according to the second exemplary embodiment.

FIG. 9 shows the reflector 2 together with the reference ring 24 inserted therein according to the second exemplary embodiment. For the sake of simplicity only the reference ring 24 is shown, as in FIG. 8, without the base 12 from FIG. 2. In the position of the reference ring 24 shown in FIG. 9, the ring has been inserted into the holder 46 in the axial direction, with the cutouts 32*b*, 32*c* and 60 having been brought into overlapping alignment with the bayonet cams 50*a*, 50*b*, 50*c* and the coding groove 30 having been brought into overlapping alignment with the corresponding referencing element of the reflector 2. The stop section 58 of the stop dog 56 from FIG. 7 has in this case been inserted into the recess 70 of the latching groove 62 shown on the right in FIG. 8. If the base 12 from FIG. 2 is now rotated with the reference ring 24 relative to the reflector 2 in the clockwise direction in order to achieve the locking position, the stop section 58 slides over the locking projection 72 into the recess 68 of the latching groove 62 shown on the left in FIG. 8. This position of the reference ring 24 relative to the reflector 2 is shown in FIG. 10. It can be seen that the locking projection 72 engages behind the stop section 58 of the stop dog 56 from FIG. 7, as a result of which the reference ring 24 is locked in place in the circumferential direction by means of the stop dog 56.

The recess 68 of the latching groove 62 shown on the left in FIG. 8 is offset somewhat toward the outside in the radial direction compared to the right-hand recess 17. The offset serves to clamp the reference ring, as is explained in the following.

In the insertion position of the reference ring 24 shown in FIG. 9, the ring is arranged roughly free of force in the holder 46. If the reference ring 24 is rotated as described above into the locking position shown in FIG. 10, the inward-facing side surface 74 on the stop dog 56 from FIG. 7 clamps the reference ring 24 against the inner circumferential surface 48 of the reflector 2 in FIG. 10 by way of a base surface 76 of the recess 68 shown on the left in FIG. 8. In order to define certain areas in which the reference ring 24 in FIG. 10 is subjected to a clamping force, two pretensioning elevations 78, 80 arranged roughly opposite the stop dog 56 are embodied on the inner circumferential surface 48. These pretensioning elevations 78, 80 are formed in the axial direction roughly between the ring 54 and the bayonet cams 50. As can be seen from FIG. 10, the reference ring 24 is clamped in a defined manner between the two pretensioning elevations 78, 80 and the stop section 58 of the stop dog 56.

Figure 11:
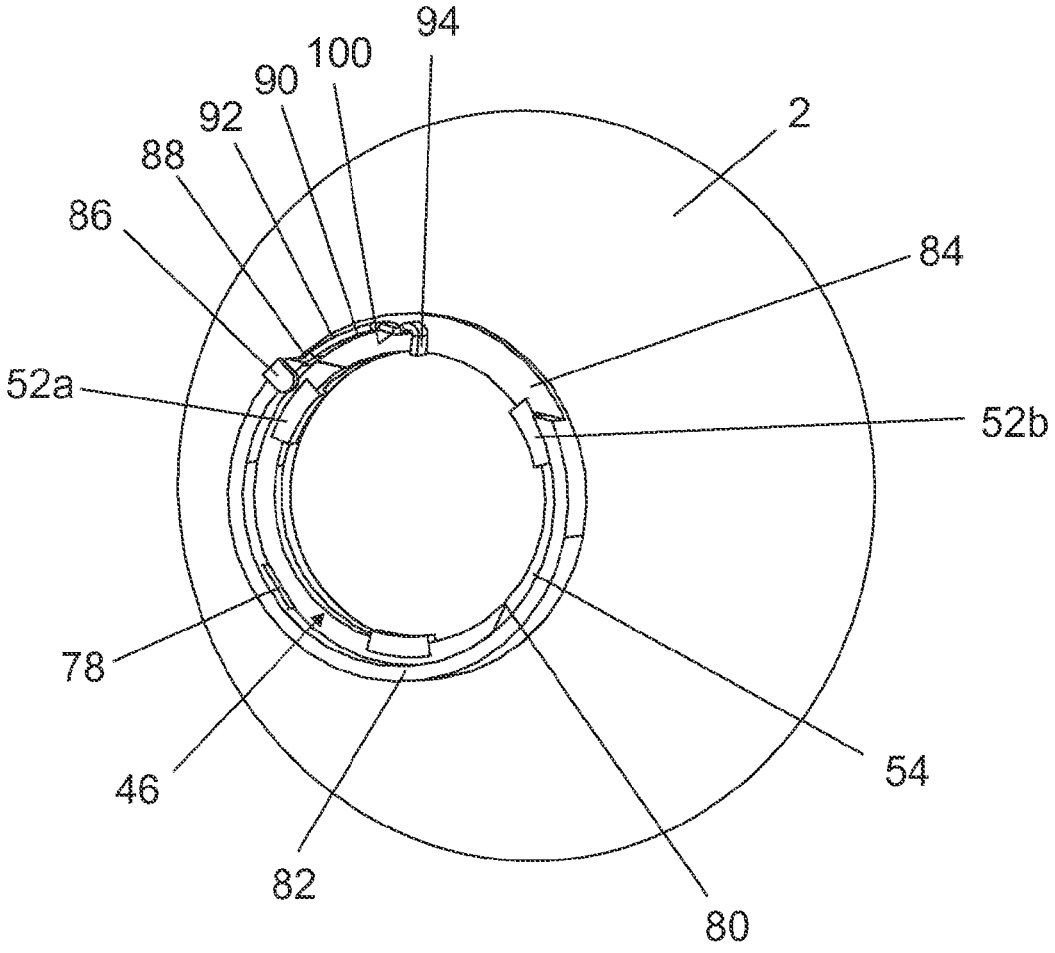
FIG. 11 shows an individual view of the reflector of the lamp unit according to a third exemplary embodiment.

FIG. 11 shows a perspective view of the reflector 2 according to a third exemplary embodiment. In this case the holder 46 is stepped back with a recess 84 from a rear end face 82 in the axial direction in the manner of a circular segment between the two locating pegs 52*a*, 52*b* arranged at the top in FIG. 11. Said recess 84 extends in the axial direction roughly as far as the ring 54 adjacent to the referencing element 86 or to the locating peg 52*a* shown at top left in FIG. 11.

A spring hook 90 projects from a left-hand side surface 88 of the recess 84 roughly in the circumferential direction. Said spring hook 90 has an elongate spring shaft 92 and a hook section 94 bent down radially inward roughly in the center of the recess 84. The spring hook 90, like the stop dog 56 from FIG. 7, serves for positioning the lamp base 12 in the circumferential direction and for clamping the reference ring 24 in place.

In contrast to the preceding exemplary embodiment, the bayonet cams 50*a*, 50*b*, 50*c* are embodied on a separate retaining ring 96. The latter is fixed on the reflector 2, as can be seen in FIG. 12, in such a way that the bayonet cams 50 are positioned in accordance with the preceding exemplary embodiments.

Figure 13:
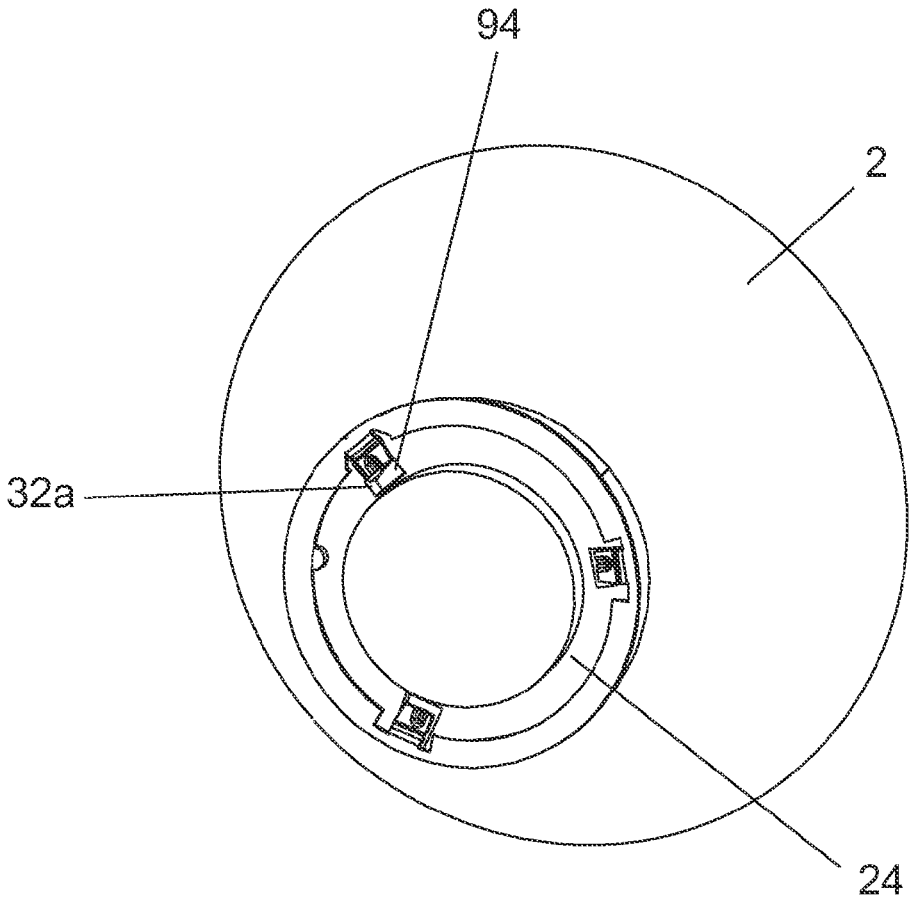
FIG. 13 shows a rear view of the reflector and the reference ring according to the third exemplary embodiment.

FIG. 13 shows the reflector 2 together with the reference ring 24 of the first exemplary embodiment from FIG. 4 in an insertion position. The hook section 94 of the spring hook 90 from FIG. 11 is therein inserted in the top cutout 32*a* of the reference ring 24. When the reference ring 24 is rotated in the clockwise direction, the hook section 94 comes into engaging contact with a left side surface 98 of the top cutout 32*a*, thereby positioning the reference ring 24 in the circumferential direction. In order to clamp the reference ring 24 against the pretensioning elevation 78, 80 from FIG. 11 by way of the spring hook 90, the latter has a radially inward-facing concavity 100 on the spring shaft 92 adjacent to the hook section 94. In the insertion position shown in FIG. 13, said concavity is arranged next to the spring hook 90 in the top cutout 32*a*. When the reference ring 24 is rotated, the concavity slides onto an outer circumferential wall 102 of the reference ring 24 and clamps the latter against the pretensioning elevations 78, 80 from FIG. 11. In this case the pretensioning force is dependent on the elasticity of the spring hook 90. The latter is manufactured for example from a metallic material or produced as a single piece with the injection molding method used for the holder 46.

Figure 12:
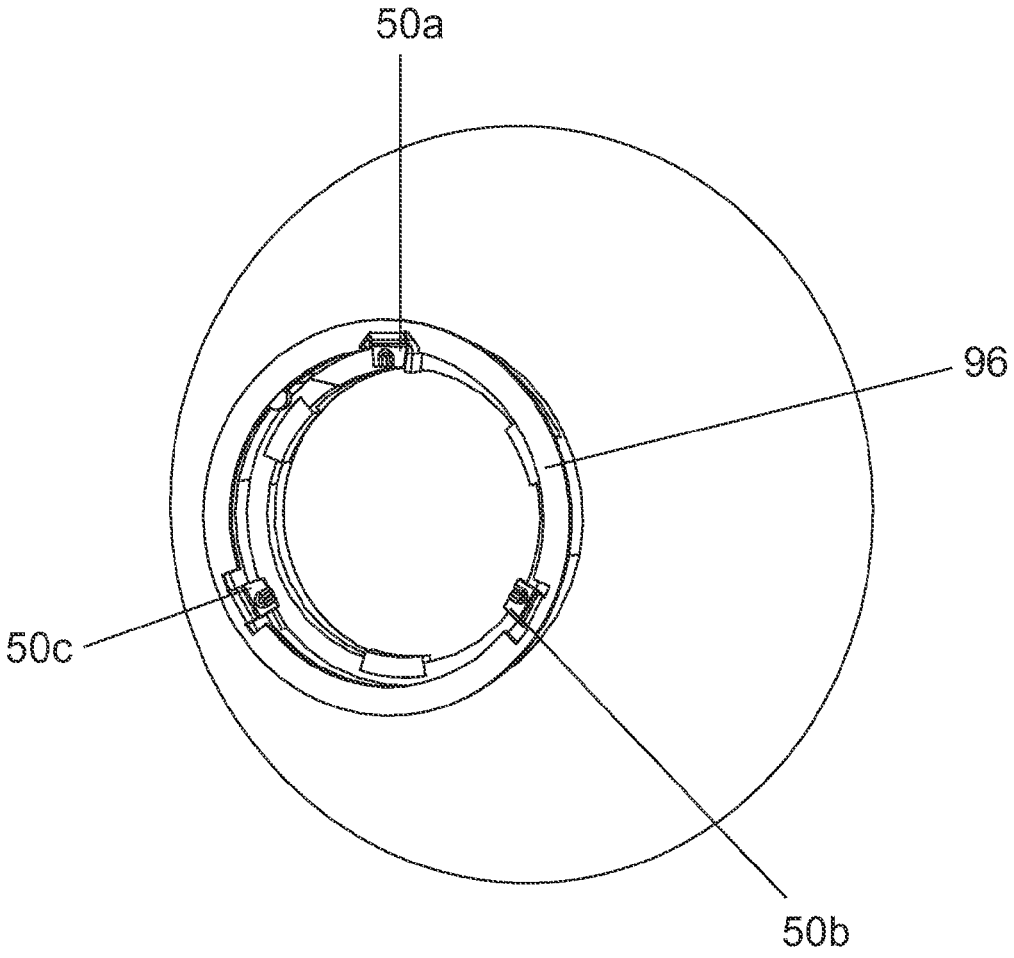
FIG. 12 shows an individual view of the reflector according to the third exemplary embodiment.
Figure 14:
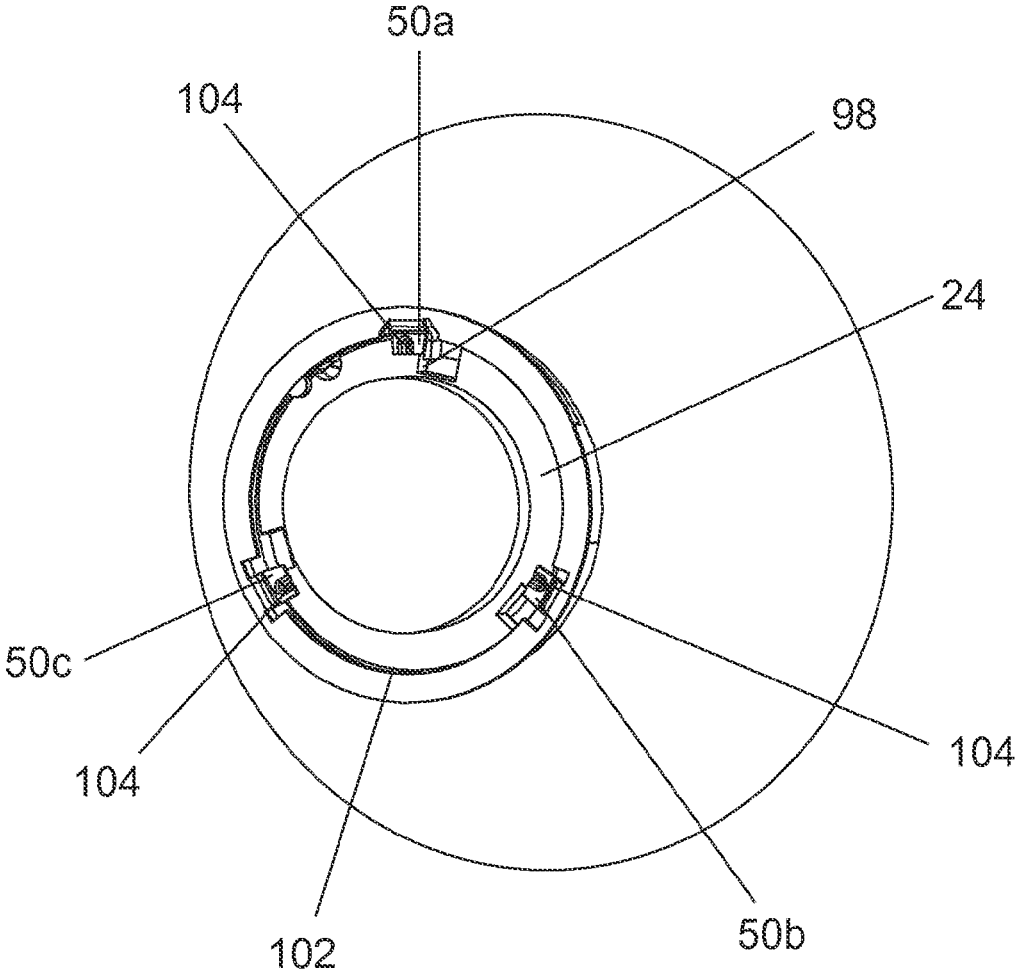
FIG. 14 shows a rear view of the reflector and the reference ring according to the third exemplary embodiment.

In order to clamp the reference ring 24 also with a high pretensioning force in the axial direction, the bayonet cams 50*a*, 50*b*, 50*c* from FIG. 12 are bent inward somewhat into the drawing plane. In order to achieve a high contact pressure per unit area between the bayonet cams 50*a*, 50*b* and 50*c* in FIG. 14 and the reference ring 24, V-shaped elevations 104 are formed on the bayonet cams 50 toward the reference ring 24.

A lamp unit is disclosed including a high-pressure discharge lamp which is inserted in a reflector, preferably of a motor vehicle headlight. The lamp has a base with a reference ring which is connected to the holder of the reflector by way of a bayonet interface.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A lamp unit comprising:

a lamp which is inserted into a reflector and which has a base with a reference ring including at least cone referencing surface which cooperatively interacts with a corresponding referencing element of a holder of the reflector, configured such that the lamp is separably connected to the holder through a bayonet coupling, wherein the bayonet coupling has circumferentially open-ended cutouts embodied on the reference ring with which radially projecting bayonet cams provided on an inner circumferential surface of the holder are associated, which bayonet cams are in overlapping alignment with the cutouts when the lamp is inserted and engage behind the reference ring during the connecting action.

2. The lamp unit as claimed in claim 1, wherein locating pegs for the reference ring which are offset with respect to he bayonet cams are configured on an inner circumferential surface of the holder.

3. The lamp unit as claimed in claim 2, wherein reference studs which can be brought into engaging contact with the locating pegs are configured on a front end face of the reference ring.

4. The lamp unit as claimed in claim 2, wherein three reference studs and correspondingly three locating pegs are provided.

5. The lamp unit as claimed in claim 1, wherein at least one stop dog onto which the bayonet cams run during the locking action is embodied on an outer circumference of the base.

6. The lamp unit as claimed in claim 1, wherein a stop dog is embodied on the inter circumferential surface roughly the same level as the locating pegs and has a stop section which extends roughly in a longitudinal direction of the reflector toward the bayonet cams and is spaced apart from the inner circumferential surface and which drops into a latching groove of the reference ring when the lamp is inserted, and wherein a groove edge section runs up onto the stop dog during the locking action.

7. The lamp unit as claimed in claim 6, wherein the latching groove is embodied as a recess in a sidewall of a cutout.

8. The lamp unit as claimed 7, wherein in a locking position of the lamp the stop section is engaged from behind by a locking projection embodied on a base surface of the cutout.

9. The lamp unit as claimed in claim 6, wherein the latching groove is embodied in such a way that in the locking position the reference ring is clamped by way of the stop dog against pretensioning elevations embodied roughly opposite the stop dog on the inner circumferential surface.

10. The lamp unit as claimed in claim 1, wherein a radial recess is incorporated into the inner circumferential surface roughly between the bayonet cam and the locating peg, in which radial recess is arranged an elongate spring hook extending roughly along an inner diameter of the inner circumferential surface and having a radially inward-facing hook section in the region of a bayonet cam, onto which hook section a cutout of the reference ring runs during the locking action.

11. The lamp unit as claimed in claim 10, wherein a spring shaft of the spring hook is embodied in such a way that the hook clamps the reference ring in the locking position against the pretensioning elevations embodied roughly opposite the spring hook on the inner circumferential surface.

12. The lamp unit as claimed in claim 11, having additional radial pegs for an electrical connector.

13. The lamp unit as claimed in claim 12, wherein the lamp is a high-pressure discharge lamp.

14. The lamp unit as claimed in claim 1, wherein three bayonet cams and correspondingly three cutouts are provided.

15. The lamp unit as claimed in claim 1, wherein the cutouts extend in the radial direction roughly up to an outer circumference of a base sleeve from which the reference ring projects radially.

16. The lamp unit as claimed in claim 15, wherein the cutouts are implemented roughly in a rectangular shape, viewed in the axial direction.

* * * * *